United States Patent [19]

Scheffler

[11] 4,156,323

[45] May 29, 1979

[54] PIVOTABLE TREE STAND

[76] Inventor: Richard N. Scheffler, 6350 Worlington, Birmingham, Mich. 48010

[21] Appl. No.: 842,558

[22] Filed: Oct. 17, 1977

[51] Int. Cl.[2] ..... A47G 33/12

[52] U.S. Cl. ..... 47/40.5; 248/516; 403/143

[58] Field of Search ..... 47/40.5; 248/515, 516; 403/141, 143

[56] References Cited

U.S. PATENT DOCUMENTS

| | | | |
|---|---|---|---|
| 1,789,509 | 1/1931 | Bergstrom | 248/516 |
| 2,543,849 | 3/1951 | Hendrickson | 47/40.5 |
| 2,812,916 | 11/1957 | Jonasson et al. | 47/40.5 |
| 2,893,668 | 7/1959 | Applegate | 47/40.5 X |
| 2,933,274 | 4/1960 | Mausolf | 47/40.5 |
| 3,231,227 | 1/1966 | Weining | 47/40.5 |
| 3,779,493 | 12/1973 | Gidlof | 47/40.5 |

FOREIGN PATENT DOCUMENTS

| | | | |
|---|---|---|---|
| 539215 | 4/1957 | Canada | 248/515 |
| 235181 | 1/1911 | Fed. Rep. of Germany | 248/516 |

*Primary Examiner*—Edgar S. Burr
*Assistant Examiner*—Steven A. Bratlie
*Attorney, Agent, or Firm*—Basile and Weintraub

[57] ABSTRACT

A tree-supporting stand having a central support member mounting a plurality of radially extending legs, each of which is adapted to engage a horizontal surface for supporting a Christmas tree in an upright position so as to facilitate decorating and displaying the latter. The stand further comprises a cup-shaped holder which receives the butt end of the tree so as to support the tree in a vertical position. Fastening means carried by the cup-shaped holder engage the butt end of the tree to secure the tree to the holder. The cup-shaped holder is pivotally attached to the central support member in such a manner that the cup-shaped holder may be inclined with respect to the vertical to permit proper positioning of the tree and to compensate for irregularities in the tree shape. Means are provided for locking the holder to the support member after the tree has been positioned.

1 Claim, 6 Drawing Figures

PIVOTABLE TREE STAND

BACKGROUND OF THE INVENTION

I. Field of the Invention

The present invention relates to tree supporting stands and, more particularly, to a stand for mounting Christmas trees in a substantially upright position to facilitate the decorating and displaying of the Christmas tree.

II. Description of the Prior Art

Stands for supporting trees, such as Christmas trees, in an upright position are well known and have been employed for many years. U.S. Pat. No. 3,051,423 is typical of many of the known devices for supporting Christmas trees in a vertical position. This patent discloses a stand that has a water-tight container including a frusto-conically shaped, funnel-like top having a central opening for the reception of the tree trunk. The funnel-like top aids in the filling of the container with water for the tree. For the support of the tree trunk a sleeve is fixed within the opening in the top and means, such as thumb screws or the like, threadingly engage the walls of the sleeve so as to secure the tree trunk to the container. The construction is typical of many commercially available Christmas tree stands. Of particular interest is that this device utilizes an attachment secured to the lower terminal end of the tree trunk such that the same is received in a corresponding recess in the base of the tree holder so as to secure the terminal end of the tree to the holder, as well as permit a relative amount of pivotal movement between the tree and the holder as the thumb screws are moved with respect to the tree.

U.S. Pat. No. 1,694,815 discloses a Christmas tree stand which includes a plurality of radially extending legs that rotatably support a cup-shaped receptacle which, in turn, is provided with a plurality of thumb screws that engage the tree trunk when the same is positioned within the cup-shaped recess so as to secure the tree trunk to the stand. A bearing-type arrangement between the cup-shaped support and the legs permits relative, rotational movement of the trce about the fixed stand to facilitate decorating and positioning of the tree.

U.S. Pat. No. 2,681,780 discloses a Christmas tree stand that includes a rotatable holder for the Christmas tree trunk, the holder containing water for the tree and being so designed so as to permit raising and lowering of the stand to achieve a vertical adjustment of the tree height after it has been mounted to the holder. Suitable locking devices are provided to lock the tree holder in an adjusted, vertical position, while at the same time permitting the tree to be rotated relative to the tree holder so as to present the most attractive side of the tree.

U.S. Pat. No. 2,814,099 discloses a device which permits relative, rotational movement of a support end with respect to a fixed, ground-engaging support element. The support end of the device provides a means for adjusting the same so that the article carried thereby may be raised and lowered and also tilted and rotated about a vertical axis.

While each of the aforementioned patents is relevant to applicant's invention in that they disclose various types of apparatus for the mounting of a Christmas tree so as to support the same in a vertical position, none disclose applicant's novel and unique means of a pivotal connection between the Christmas tree stand legs and the Christmas tree trunk-engaging portion thereof so as to permit the adjustment of the tree position and incline the tree with respect to the vertical so as to provide a simple means for adjusting for irregularities in the shape of the tree and, in particular, for crooked trunks.

PRIOR ART STATEMENT

In the opinion of the applicant, the aforementioned United States Letters Patents represent the closest prior art of which applicant is aware.

SUMMARY OF THE INVENTION

The present invention, which will be described subsequently in greater detail, comprises a stand for supporting a tree, such as a Christmas tree, in a substantially vertical position. The stand comprises a support having a plurality of radially disposed legs and a cup-shaped holder which receives the butt end of the tree so as to support the tree in an upright position. Means carried by the holder engage the tree so as to secure the tree to the holder. Pivot means are carried by the support and couple the holder to the support in such a manner that the holder may be pivoted with respect to the support to provide for adjustment in the position of the tree with respect to the vertical. Means are carried by the support to lock the holder at a selected, inclined position.

It is therefore a primary object of the present invention to provide a Christmas tree holder which is superior to the prior art structures and one which is relatively simple and durable in construction.

It is a further object of the present invention to provide a tree holder which will support a tree, such as a Christmas tree, in a substantially upright position and one which permits the simple adjustment in the positioning of the tree such that the tree may be rotated with respect to the tree stand or may be selectively inclined with respect to the vertical so as to present the most attractive positioning of the tree.

It is a further object of the present invention to provide a Christmas tree stand of the type described which is provided with a simple means for locking the Christmas tree in a selected position.

It is a further object of the present invention to provide an improved, tree-supporting stand of the type described wherein a Christmas tree or the like may be readily disposed, manipulated and secured to the stand.

Other objects, advantages and applications of the present invention will become apparent to those skilled in the art of tree-supporting stands when one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
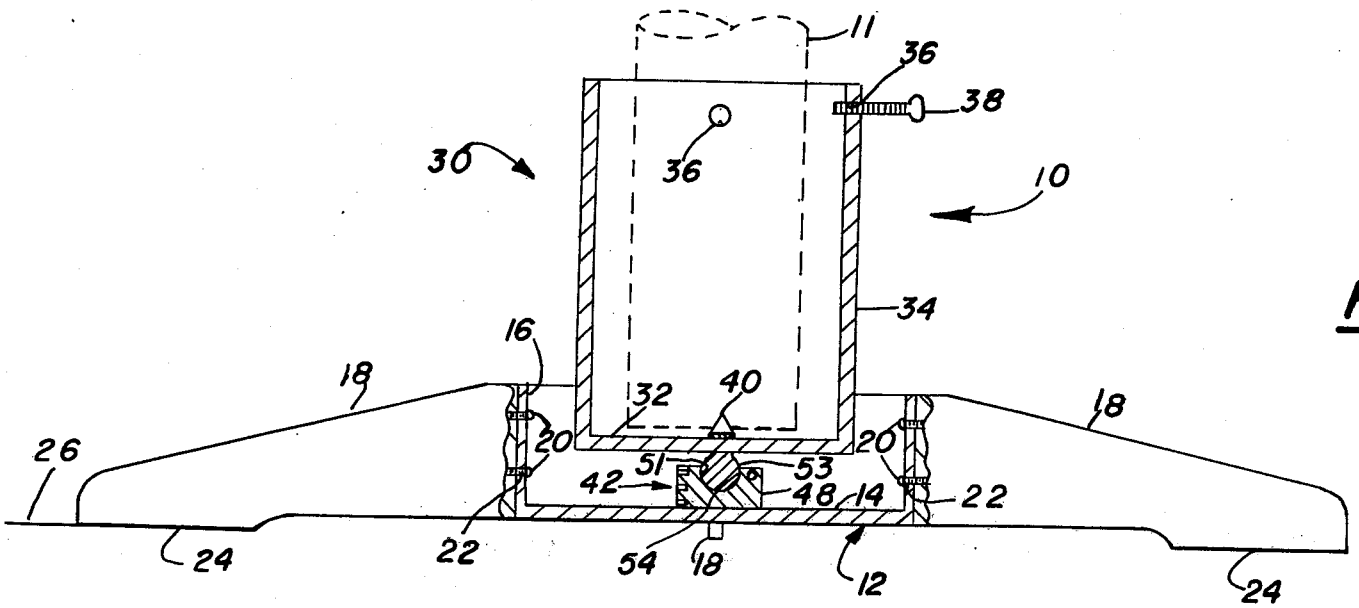
FIG. 1 is a cross-sectional view through a tree-supporting stand constructed in accordance with the principles of the present invention and taken along Line 1—1 of FIG. 2.
Figures 2, 3:
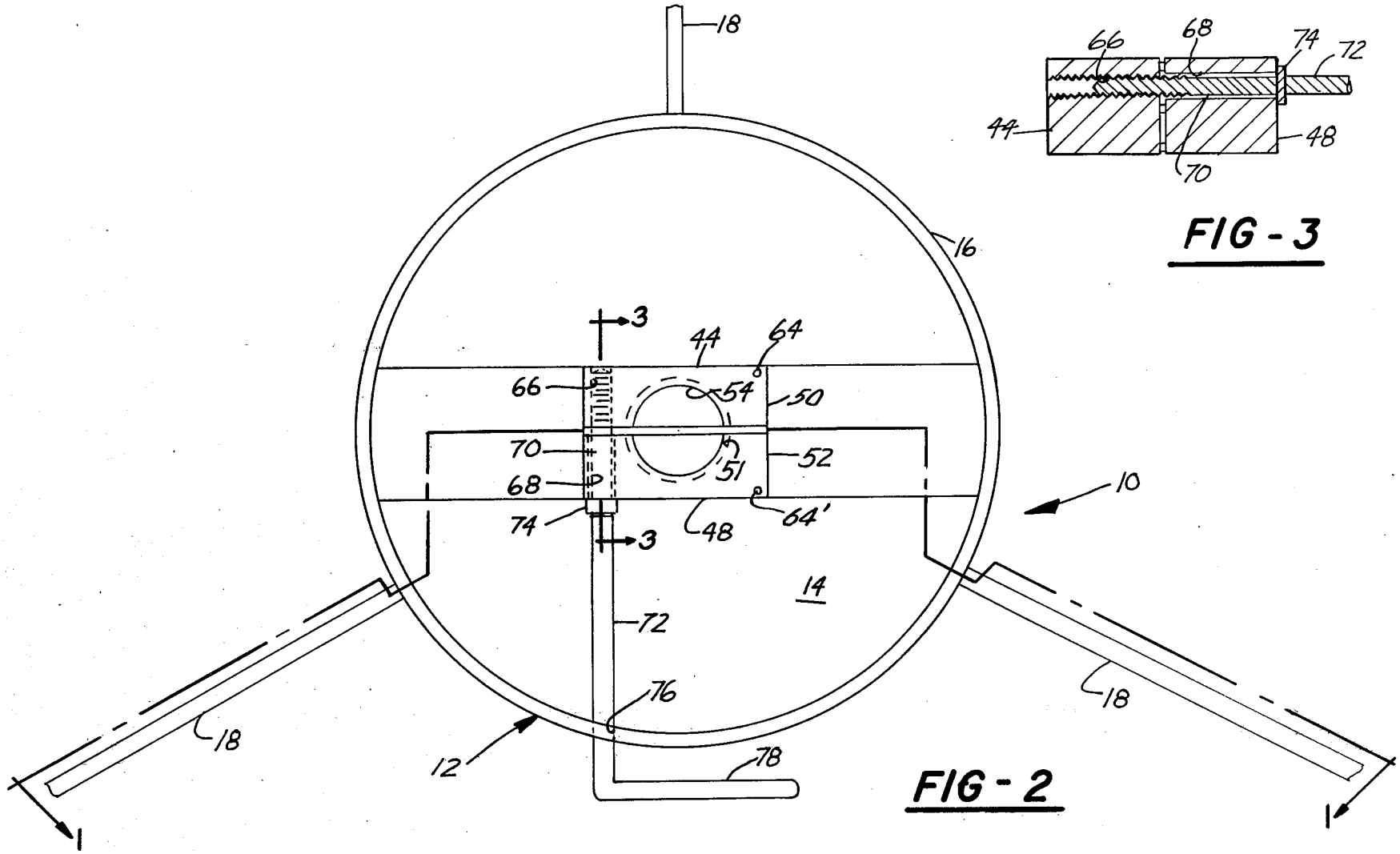
FIG. 2 is a top plan view of the tree-supporting stand illustrated in FIG. 1 with the central cup-shaped holder being removed for clarity.
FIG. 3 is a fragmentary, cross-sectional view through the tree-supporting stand taken along Line 3—3 of FIG. 2.

Referring now to the drawing and, in particular, to FIGS. 1 and 2 wherein there is illustrated one example of the present invention in the form of a tree stand 10 for supporting a tree, such as a Christmas tree 11, in an upright position. The stand 10 comprises a central support member 12 that has a circular base 14 and a circular side wall 16. A plurality of radially extending legs 18 are strategically placed about the central support member 12 so as to support the member 12 in the position illustrated. The legs 18 are secured to the wall 16 by any suitable means, such as threaded fasteners 20, that extend through apertures 22 in the wall 16 and into threaded engagement with the adjacent face of the legs 18. The legs 18 each have a support surface 24 which engages the floor 26 so as to maintain the base 14 in a generally horizontal plane.

As can best be seen in FIG. 1, the tree stand 10 further comprises a water-tight, cylindrically shaped holder 30 that has a base 32 and an upright circular wall 34. The upper portion of the wall 34 has a plurality of threaded apertures 36 through which threaded fasteners, such as thumb screws 38, radially extend, for a purpose to be described hereinafter. The base 32 of the holder 30 has a pair of centering projecting prongs 40 which are adapted to engage the bottom end of the tree trunk 11 to secure it to the base 32. Rotation of the thumb screws 38 toward the tree trunk 11 and engagement therewith secures the tree trunk 11 to the holder 30. Once the tree trunk 11 has been secured to the holder 30 by means of the projecting prongs 40 and the thumb screws 38, the holder 30 and the tree 11 supported thereby move together as a unit.

The tree holder 30 is connected to the central support member 12 by means of a coupling mechanism 42 which, as will be described in greater detail hereinafter, permits the holder 30 and, thus, the tree 11 carried thereby to be both pivoted with respect to the vertical and rotated about the vertical or horizontal, as desired.

In the preferred embodiment the coupling mechanism 42 comprises a pair of socket members 44 and 48 which have their adjacent ends (see FIG. 2) 50 and 52, respectively, secured to each other in such a manner that relative, pivotal movement is attainable. Preferably, the socket member 44 is secured to the base 14 by means of a plurality of threaded fasteners 49 (FIGS. 5 and 6) which extend upwardly through bores in the base 14 and threadingly engage the socket member 44. Thus, the socket member 48 is movable with respect to both the base 14 and the adjacent socket member 44. As can best be seen in FIGS. 1 and 4, the socket members 44 and 48 join each other to define a spherical socket 51 within which is received a spherical pivot member 53. The socket 51 has a shape which is greater than a hemisphere such that the upper edge 54 defines a simple means for retaining the ball 53 within the socket 51. As will be described hereinafter, the socket member 48 is movable with respect to the socket member 44 from a first position wherein it is in close proximity to the socket member 44 and clampingly engages the ball 53 so as to prevent relative, pivotal movement between the ball 53 and the socket 51 to a second position wherein the socket member 48 is moved laterally away from the socket member 44 a sufficient amount such that there is free movement of the ball 53 with respect to the socket 51. Since the ball 53 is secured to the bottom surface of the holder 30, it can be seen that when the socket member 48 is in the second position and there is relative, pivotal motion between the ball 53 and the coupling mechanism 42, the holder 30 and, thus, the tree 11 carried thereby may be pivoted with respect to the vertical. Additionally, the tree 11 in the holder may be rotated about the vertical axis. It can be seen that from this relative, pivotal motion between the holder 30 and the support member 12, the Christmas tree 11 may be moved to a substantial number of positions. Thus, the tree 11 may first be attached to the holder 30 by means of the thumb screws 38 and then rotated, as desired, to position the tree 11 in its most optimum position with respect to its appearance and to incline the tree 11 such that the top of the tree 11 appears to be positioned in the vertical, even if the base of the tree may be at an inclination because of the curvature of the tree trunk. Once the tree 11 has been properly positioned with respect to the vertical, the socket member 48 is moved to the first position wherein it clampingly engages the ball 53 so as to prevent further pivotal movement between the socket 51 and the ball 53, thereby locking the tree 11 in the desired, inclined position. The manner in which such locking is achieved will be described hereinafter.

Figure 4:
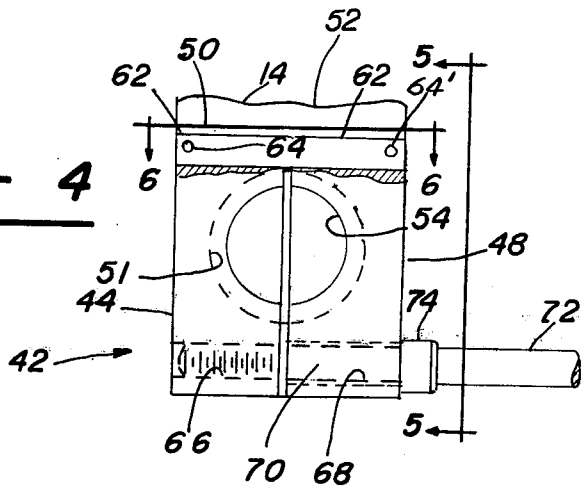
FIG. 4 is a fragmentary, enlarged, top view of the coupling mechanism illustrated in FIG. 2 of the drawings.
Figure 5:
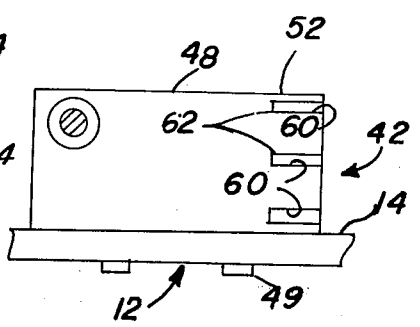
FIG. 5 is a side elevational view of the coupling mechanism as seen from Line 5—5 of FIG. 4.
Figure 6:
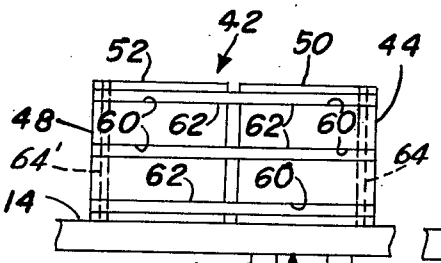
FIG. 6 is a rear elevational view of the coupling mechanism as seen from Line 6—6 of FIG. 4.

As can best be seen in FIGS. 4, 5 and 6, the adjacent ends 50 and 52 of the socket members 44 and 48, respectively, are each provided with a plurality of lateral slots 60 which slideably receive connecting plates 62. The opposite, lateral ends of the connecting plates 62 are secured to the socket members 44 and 48 by means of longitudinal pins 64 (and 64′ (see FIGS. 4 and 6) that extend through appropriate apertures in the connecting plates 62 and the socket members 44 and 48. This permits the socket member 48 to move with respect to the base 14 and to be pivoted laterally with respect to the socket member 44 in a simple and convenient manner. The socket member 48 may pivot about the axis defined by the pin 64′ located in the socket member 48, while the connecting plates 62 each pivot about the axis defined by the pin 64 located in the socket member 44. This permits a simple separation of the socket members 44 and 48 such that the socket members 44 and 48 are movable with respect to each other between the aforementioned first and second positions.

As can best be seen in FIG. 3, the socket members 44 and 48, respectively, have aligned threaded bore 66 and clearance bore 68 which threadingly receive a threaded end 70 of an L-shaped socket wrench 72. The socket wrench 72 has an enlarged section 74 which is adapted to engage the outer surface of the socket member 48 as the socket wrench 72 is rotated in a clockwise direction, as viewed in FIG. 3 of the drawings. The engagement of the enlarged section 74 with the outside surface of the socket member 48 causes the socket members 44 and 48 to be drawn toward each other exerting a clamping force on the ball 53. It can be seen that the engagement of the socket wrench 72 with the threaded bore 66 and clearance bore 68 in the socket members 44 and 48, respectively, provides an extremely simple means for securely locking the ball 53 in any one of a multiple of selected positions. The socket wrench 72 extends through an aperture 76 (FIG. 2) in the wall 16 such that its right-angled, end leg 78 may be grasped by a user and rotated in a desired direction so as to tighten or loosen the engagement of the socket members 44 and 48 in the aforementioned manner. By rotating the socket wrench 72 substantially counterclockwise, the threaded end 70 thereof may be disengaged completely from the threaded bore 66 and clearance bore 68 whereupon the movable socket member 48 may be rotated a substantial degree so as to permit the withdrawal of the ball 53 from the socket 51. This permits the simple separation of the holder 30 from the central support member 12 for purposes of manufacture, assembly and storage of the item.

It can thus be seen that applicant has disclosed an extremely simple and novel means for mounting a tree in a vertical position and wherein means are provided for inclining the tree with respect to the vertical so as to be able to compensate for irregularities in the shape of the tree, while at the same time providing a simple means for locking and unlocking the pivotal movement that is permitted between the central support member 12 and the tree holder 30. It should also be noted that the tree holder 3 is of a water-tight construction so as to make provisions for water within the holder 30 to keep the tree 11 fresh.

While only one example of applicant's invention has been disclosed, it should be apparent to those skilled in the art of tree holders and stands that other forms of applicant's invention may be had, all coming within the spirit of the invention and scope of the appended claims.

What is claimed is as follows:

1. A tree-supporting stand comprising:

a support housing having a circular base and a circular wall extending upwardly from said circular base;

a plurality of radially disposed leg members;

means releasably attaching said leg members to said housing circular wall at arcuately spaced locations for supporting said housing in such a manner that the housing circular base is disposed in a horizontal plane;

a water-holding, cup-shaped holder for receiving the butt end of a tree, said holder having a bottom wall, an upright cylindrical wall and a plurality of radial bores in said holder cylindrical wall at arcuately spaced locations and a plurality of thumb screws threadingly engaging said bores and movable radially inwardly into said holder whereby said thumb screws will secure a tree to said holder for supporting the tree in an upright position;

a coupling device for connecting said holder to said support housing to permit relative, pivotal movement between said support housing and said holder whereby the tree may be inclined with respect to said support housing, said coupling device comprising:

a pair of pivot members having top walls and opposing vertical faces within each of which is formed a spherically shaped surface such that said opposing vertical faces jointly define a spherically shaped recess which opens to the top walls of said pivot members, one of said pivot members being fixedly attached to the upper surface of said housing base;

a plurality of horizontally disposed connecting plates, each connecting plate having one end pivotally connected to one end of said one pivot member, the opposite ends of said connecting plates being pivotally connected to an end of said other pivot member which is adjacent said one end of said one pivot member, whereby said other pivot member is movable with respect to both said one pivot member and said housing base, such that the vertical face on said other pivot member is movable toward and away from the vertical face on said one pivot member;

a spherical ball attached to said bottom wall of said holder and projecting downwardly therefrom, said spherical ball extending through the top walls of said pivot members and received in said spherical recess and movable therein to permit relative, pivotal movement of said holder with respect to said housing base, said spherically shaped recess being sized to normally retain said spherical ball therewithin, said other pivot member being pivotally movable from a first position wherein said spherical surfaces of said pivot members tightly engage said spherical ball to prevent pivotal movement thereof with respect to said pivot members so as to lock said holder in a desired position, to a second position wherein pivotal movement of said spherical ball within said recess is permitted and said spherical ball is retained within said recess, to a third position to permit withdrawal of said spherical ball from said recess and separation of said holder from said housing; said coupling device further comprising a pair of aligned, horizontally disposed bores in said pivot members, the bore in said one pivot member being threaded;

a horizontally disposed threaded member extending through said other pivot member bore and engaging said one pivot member threaded bore, said threaded member having an enlarged section engaging the outside surface of said other pivot member whereby rotation of said threaded member in a first direction permits movement of said other pivot member from said first position to said second position and rotation of said threaded member in an opposite direction moves said other pivot member from said second position to said first position, while disengagement of said threaded member from said aligned bores permits movement of said other pivot member to said third position to permit withdrawal of said spherical ball from said recess and separation of said holder from said housing, said housing circular wall encircling and extending upwardly above said housing circular base and said holder bottom wall a sufficient distance to conceal said coupling device when said holder is pivotally connected to said housing base, said housing circular wall having an aperture aligned with said pivot members' aligned bores, said horizontally disposed threaded member extending through said housing circular wall aperture beyond the outside surface of said housing circular wall, said extending portion of said threaded member having a right-angled, bent end to facilitate the turning thereof.

* * * * *